US007623095B2

(12) United States Patent
Kwon

(10) Patent No.: US 7,623,095 B2
(45) Date of Patent: Nov. 24, 2009

(54) PLASMA DISPLAY PANEL (PDP)

(75) Inventor: Jae-Ik Kwon, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 789 days.

(21) Appl. No.: 11/389,032

(22) Filed: Mar. 27, 2006

(65) Prior Publication Data

US 2006/0267866 A1 Nov. 30, 2006

(30) Foreign Application Priority Data

May 13, 2005 (KR) ..... 10-2005-0040160

(51) Int. Cl.
*G09G 3/28* (2006.01)
*G09G 3/10* (2006.01)
*H01J 17/49* (2006.01)

(52) U.S. Cl. ..... 345/67; 345/68; 313/585; 315/169.4

(58) Field of Classification Search ..... 345/55–100, 345/204–214, 690–697; 315/169.4; 313/584–585
See application file for complete search history.

(56) References Cited

U.S. PATENT DOCUMENTS 5,541,618 A 7/1996 Shinoda
5,661,500 A 8/1997 Shinoda et al.
5,663,741 A 9/1997 Kanazawa
5,674,553 A 10/1997 Sinoda et al.
5,724,054 A 3/1998 Shinoda
5,786,794 A 7/1998 Kishi et al.
5,952,782 A 9/1999 Nanto
RE37,444 E 11/2001 Kanazawa
6,630,916 B1 10/2003 Shinoda
6,707,436 B2 3/2004 Setoguchi et al.
7,511,685 B2 * 3/2009 Kim et al. ..... 315/169.4
7,518,310 B2 * 4/2009 Yoo et al. ..... 313/585
2005/0225513 A1 * 10/2005 Jung et al. ..... 345/63

FOREIGN PATENT DOCUMENTS

JP 2845183 10/1998
JP 2917279 4/1999
JP 2001-043804 2/2001
JP 2001-325888 11/2001

* cited by examiner

*Primary Examiner*—David L Lewis
(74) *Attorney, Agent, or Firm*—Robert E. Bushnell, Esq.

(57) ABSTRACT

A Plasma Display Panel (PDP) driven by a voltage of a driving waveform causing a stable discharge, by which electrodes are disposed to surround sides of a discharge cell to efficiently utilize discharge space, thereby improving light-emitting efficiency, and a voltage of a falling ramp type pulse waveform is supplied to an electrode to which a reset pulse is supplied during an initial reset stage, thereby improving its ability to control a wall voltage which is accumulated around each of the electrodes and is disposed on sides of the discharge cell.

13 Claims, 14 Drawing Sheets

PLASMA DISPLAY PANEL (PDP)

CLAIM OF PRIORITY

This application makes reference to, incorporates the same herein, and claims all benefits accruing under 35 U.S.C.§119 from an application for PLASMA DISPLAY PANEL earlier filed in the Korean Intellectual Property Office on the 13$^{th}$ of May 2005 and there, duly assigned Serial No. 10-2005-0040160.

BACKGROUND OF THE INVENTION

1. Field of the Invention

The present invention relates to a plasma display panel (PDP), and more particularly, to a PDP driven by a voltage of a driving waveform causing a stable discharge, by which electrodes are disposed to surround sides of a discharge cell to efficiently utilize discharge space, thereby improving light-emitting efficiency, and a voltage of a falling ramp type pulse waveform is supplied to an electrode to which a reset pulse is supplied during an initial reset stage, thereby improving its ability for controlling a wall voltage which is accumulated around each of the electrodes and is disposed sides of the discharge cell.

2. Description of the Related Art

A plasma display panel (PDP) is a flat display having a wide screen. The PDP displays a desired image using visible light rays generated by sealing discharge gas and supplying discharge voltage between two substrates on which a plurality of electrodes are formed to generate vacuum ultraviolet rays and exciting phosphors on which the vacuum ultraviolet rays are formed in a predetermined pattern.

The PDP has a front panel and rear panel as its display panels. A conventional PDP includes a front substrate, a pair of sustain discharge electrodes for causing a sustain discharge, a dielectric layer, and a protection film on the front panel, and a rear substrate, an address electrode, a dielectric layer, barrier ribs, and a phosphor layer, etc. on the rear panel. The front and rear substrates are spaced apart from each other and face each other in parallel. A space between the two substrates is a unit cell space that is partitioned by the barrier ribs and generates a discharge to form a discharge cell.

The PDP is driven using an address display separation method that supplies a waveform voltage to each of the electrodes in which the waveform voltage is classified into a reset period in which every discharge cell is initialized, an address period in which a discharge cell to effect a sustain discharge is selected, and a sustain discharge period in which sustain discharge for the selected discharge cell is effected.

The conventional PDP has low permeability with respect to visible light rays, since the visible light rays generated by exciting the phosphor must pass through the front substrate, the pair of sustain discharge electrodes, the dielectric layer, and the protection film of the front panel. The conventional PDP also has a low light emitting efficiency since the pair of sustain discharge electrodes are disposed not in the rear and side of but in the front of the discharge cell, the pair of sustain discharge electrodes generates their sustain discharge only in the front of discharge space of the discharge cell and the discharge space is not efficiently used. Also, charged particles created by the discharge occur in the front of the discharge cell to cause ion-sputtering that damages the phosphor layer in the rear of the discharge cell, resulting in a permanent afterimage.

SUMMARY OF THE INVENTION

The present invention provides a Plasma Display Panel (PDP) driven by a voltage of a driving waveform causing a stable discharge, by which electrodes are disposed to surround sides of a discharge cell to efficiently utilize discharge space, thereby improving light-emitting efficiency, and a voltage of a falling ramp type pulse waveform is supplied to an electrode to which a reset pulse is supplied during an initial reset stage, thereby improving its ability for controlling a wall voltage which is accumulated around each of the electrodes and is disposed on sides of the discharge cell.

According to one aspect of the present invention, a Plasma Display Panel (PDP) is provided including: front and rear substrates spaced apart from each other and facing each other in parallel; barrier ribs partitioning spaces between the front substrate and the rear substrate into a plurality of discharge cells having front, rear, and sides; an X electrode and a Y electrode surrounding the sides of the discharge cell to be parallel to the front and rear of the discharge cell and extending in a direction in parallel to the front and rear of the discharge cell; an R electrode arranged between the X electrode and the Y electrode, surrounding the sides of the discharge cell to be parallel to the front and rear of the discharge cell, and extending in a direction in parallel to the front and rear of the discharge cell and perpendicular to an extending direction of the X electrode and the Y electrode; and a phosphor layer arranged on the rear of the discharge cell. The PDP is driven by a waveform voltage that is classified into a reset period adapted to initialize all the discharge cells, an address period adapted to select a discharge cell that generates a sustain discharge, and a sustain discharge period adapted to generate the sustain discharge for the selected discharge cell; and the PDP is driven by supplying a waveform voltage sequentially having a first falling ramp type pulse, a rising ramp type pulse, and a second falling ramp type pulse to the R electrode, a rising step waveform voltage to the X electrode, and a ground voltage to the Y electrode in the reset period.

The first falling ramp type pulse is preferably a waveform pulse that is maintained at a ground voltage, ramp-falls to a first R electrode reset voltage having a lower electrical potential than that of the ground voltage, is maintained at the first R electrode reset voltage, step-rises to the ground voltage, and again is maintained at the ground voltage.

The rising ramp type pulse is preferably a waveform pulse that is maintained at a second R electrode reset voltage having a higher electrical potential than that of the ground voltage, ramp-rises to a third R electrode reset voltage having a higher electrical potential than that of a second R electrode reset voltage, and is maintained at the third R electrode reset voltage.

The second falling ramp type pulse is preferably a waveform pulse that ramp-falls from a second R electrode reset voltage having a higher electrical potential than that of a ground voltage to a fourth R electrode reset voltage having a lower electrical potential than that of the second R electrode reset voltage, and is maintained at the fourth R electrode reset voltage.

The electrical potential of the fourth R electrode reset voltage is preferably less than or equal to the electrical potential of the ground voltage.

The rising step waveform voltage pulse is preferably a waveform pulse that is maintained at the ground voltage, step-rises to an X electrode reset voltage having a higher electrical potential than that of the ground voltage, and is maintained at the X electrode reset voltage.

During the address period, an X electrode address voltage having a higher electrical potential than that of a ground voltage is preferably supplied to the X electrode, a pulse waveform voltage that is sequentially maintained at the ground voltage, a Y electrode address voltage having a higher electrical potential than that of the ground voltage during a predetermined period, and the ground voltage is preferably supplied to the Y electrode, and a pulse waveform voltage that is sequentially maintained at a first R electrode address voltage having a higher electrical potential than that of the ground voltage, a second R electrode address voltage having a lower electrical potential than that of the first R electrode address voltage during the predetermined period, and the first R electrode address voltage is preferably supplied to the R electrode.

During the sustain discharge period, a ground voltage and the sustain discharge voltage are preferably alternately supplied to the X electrode at predetermined period intervals, the sustain discharge voltage and the ground voltage are preferably alternately supplied to the Y electrode in opposition to the ground voltage and the sustain discharge voltage supplied to the X electrode, an R electrode sustain voltage having a higher electrical potential than that of the ground voltage is preferably supplied to the R electrode.

According to another aspect of the present invention, a method of driving a Plasma Display Panel (PDP) including an X electrode and a Y electrode spaced apart from each other and extending in parallel and an R electrode crossing the X electrode and the Y electrode and arranged between the X electrode and a Y electrode, discharge cells arranged in the crossed space, and the X, Y, and R electrodes surrounding the discharge cells is provided, the method including: defining a plurality of sub-fields in a unit frame according to each of gradation weights in order to display time-division gradation, each sub-field being divided into a reset period, an address period, and a sustain discharge period every sub-field; and supplying a scan pulse to the R electrode and a display data signal to the Y electrode during the address period.

The method preferably further includes sequentially supplying a first falling ramp type pulse, a rising ramp type pulse, and a second falling ramp type pulse to the R electrode during the reset period.

The method preferably further includes continuously supplying a positive R electrode sustain voltage to the R electrode and alternately supplying a sustain pulse to the Y electrode and the X electrode during the sustain discharge period.

The method preferably further includes supplying a rising step waveform voltage to the X electrode from the application of the second falling ramp type pulse to the end of the address period.

According to still another aspect of the present invention, a method of driving a Plasma Display Panel (PDP) including an X electrode and a Y electrode spaced apart from each other and extending in parallel and an R electrode crossing the X electrode and the Y electrode and arranged between the X electrode and a Y electrode, discharge cells arranged in the crossed space, and the X, Y, and R electrodes surrounding the discharge cells is provided, the method including: defining a plurality of sub-fields in a unit frame according to each of gradation weights in order to display time-division gradation, each sub-field divided into a reset period, an address period, and a sustain discharge period; and sequentially supplying a first falling ramp type pulse, a rising ramp type pulse, and a second falling ramp type pulse are to the R electrode during the reset period.

BRIEF DESCRIPTION OF THE DRAWINGS

A more complete appreciation of the present invention and many of the attendant advantages thereof will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

The present invention will now be described more fully with reference to the accompanying drawings, in which exemplary embodiments of the invention are shown. The present invention can, however, be embodied in many different forms and should not be construed as being limited to the embodiments set forth herein. Rather, these embodiments are provided so that this disclosure will be thorough and complete, and will fully convey the concept of the present invention to those skilled in the art.

Figure 1:
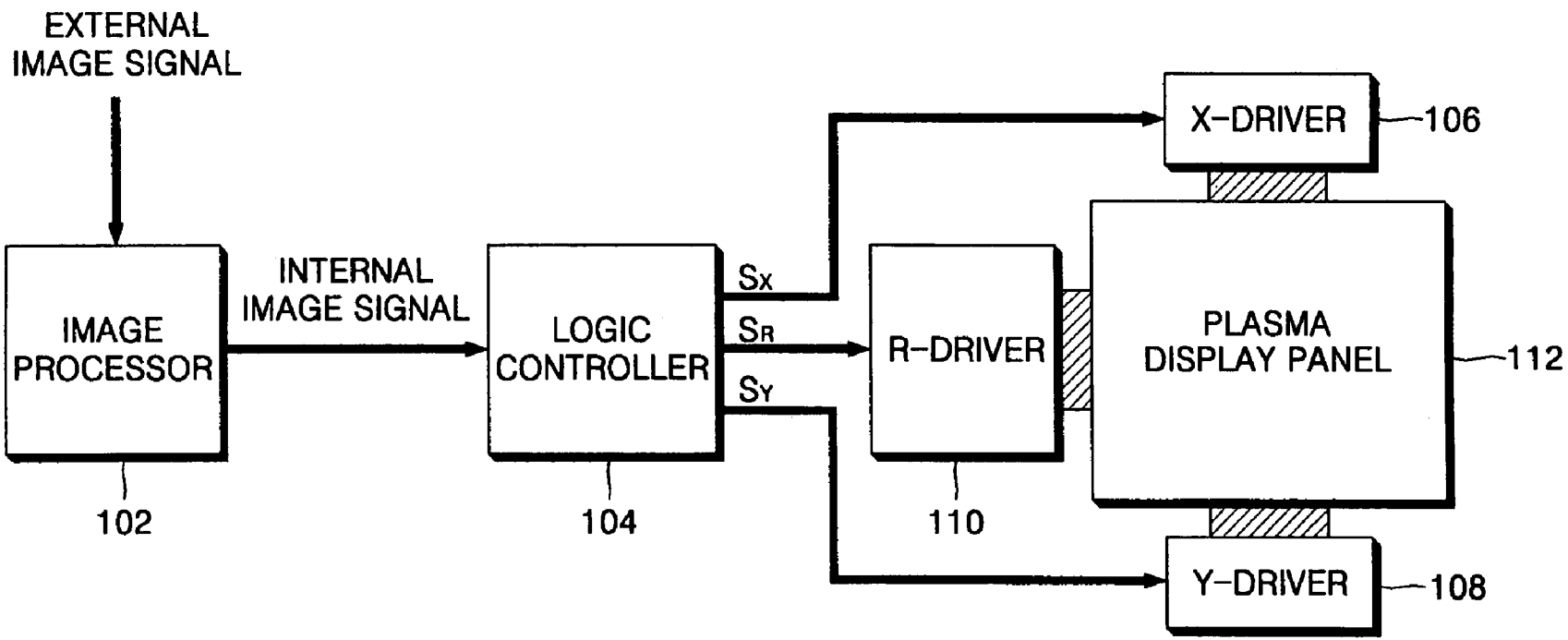
FIG. 1 is a block diagram of an apparatus to drive a Plasma Display Panel (PDP) according to an embodiment of the present invention.

FIG. 1 is a block diagram of an apparatus to drive a Plasma Display Panel (PDP) according to an embodiment of the present invention.

Referring to FIG. 1, the apparatus includes an image processor 102, a logic controller 104, an X driver 106, a Y driver 108, an R driver 110, and a display panel 112.

The image processor 102 converts an external analog image signal, such as a PC signal, a DVD signal, a video signal, a TV signal, etc. into a digital signal, image-processes the converted digital signal, generates an internal image signal, and transmits the generated internal image signal to the logic controller 104. The internal image signal includes red (R), green (G), and blue (B) image data, a clock signal, and vertical and horizontal synchronization signals.

The logic controller 104 generates an X driver control signal SX, a Y driver control signal SY, and an R driver control signal SR by processing a gamma correction, and an Automatic Power Control (APC) for the internal image signal received from the image processor 102. The generated X driver control signal SX, Y driver control signal SY, and R is driver control signal SR are respectively transmitted to the X driver 106, the Y driver 108, the R driver 110.

The X driver 106 receives the X driver control signal SX from the logic controller 104 and supplies a Y electrode driving voltage to the X electrodes X1, X2, . . . , Xn of the PDP.

The Y driver 108 receives the Y driver control signal SY from the logic controller 104 and supplies the Y electrode driving voltage to the Y electrodes Y1, Y2, . . . , Yn of the PDP.

The R driver 110 receives the R driver control signal SR from the logic controller 104 and supplies an R electrode driving voltage to the R electrodes R1, R2, . . . , Rn of the PDP.

The display panel 112, which is a collection of all of the discharge cells of the PDP and their peripheral constituents, displays an image corresponding to the external image signal input to the PDP input using visible light rays emitted by a discharge cell selected by respectively supplying the X, Y, and R electrode driving voltages to the X, Y, and R electrodes. The physical structure of the display panel 112 is described in detail below with reference to FIGS. 2A and 2B.

Figure 2A:
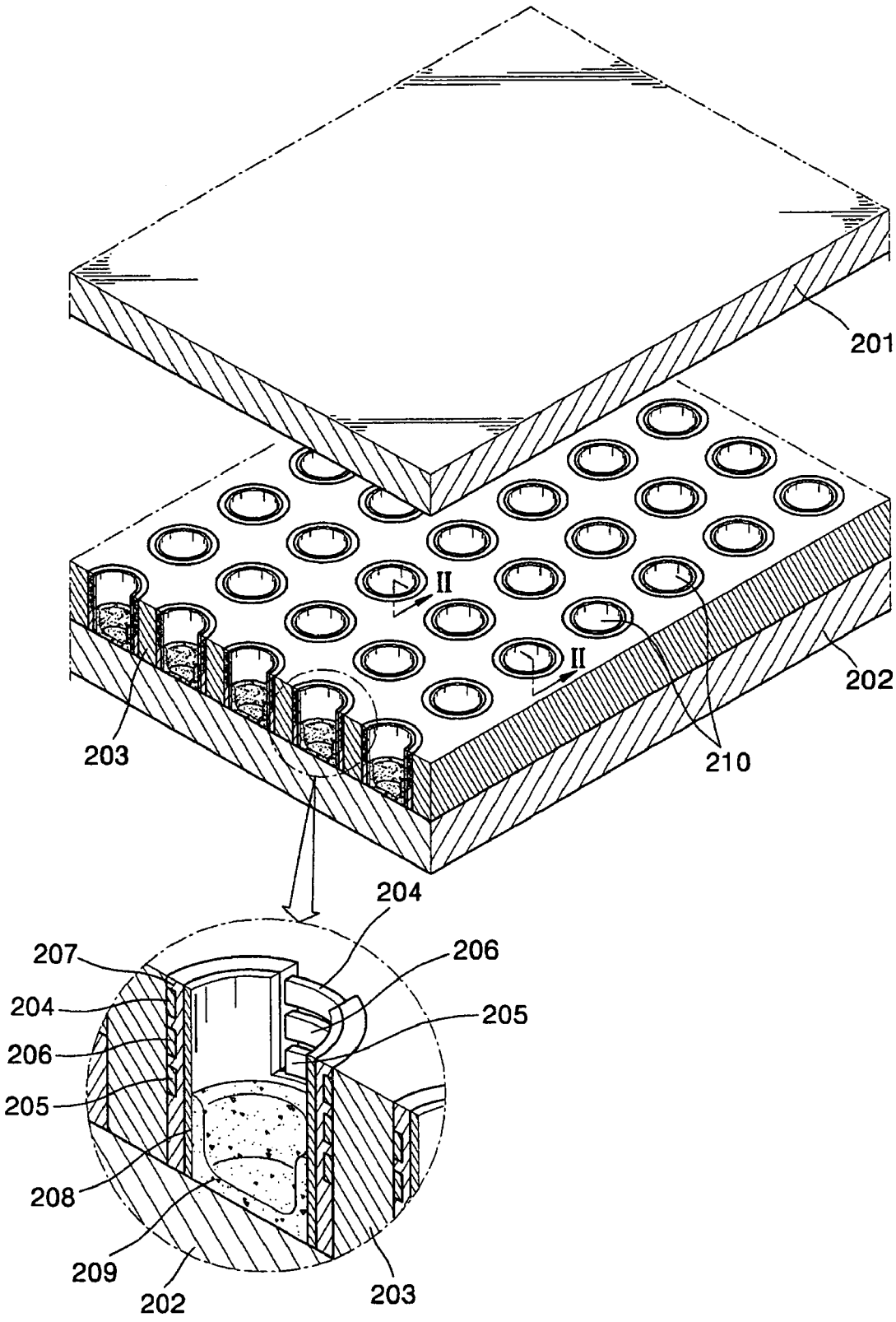
FIG. 2A is a partially exploded perspective view of the physical structure of a display panel of the PDP of FIG. 1.
Figure 2B:
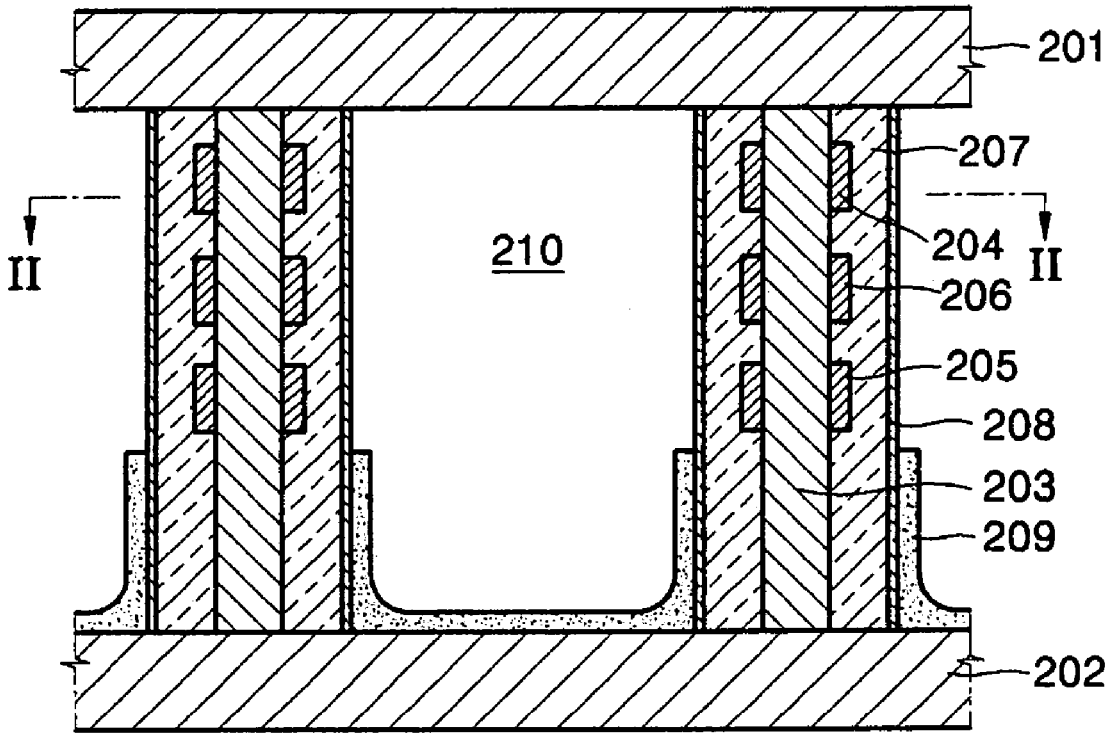
FIG. 2B is a cross-sectional view of the display panel taken along line II-II of FIG. 2A.
Figure 2C:
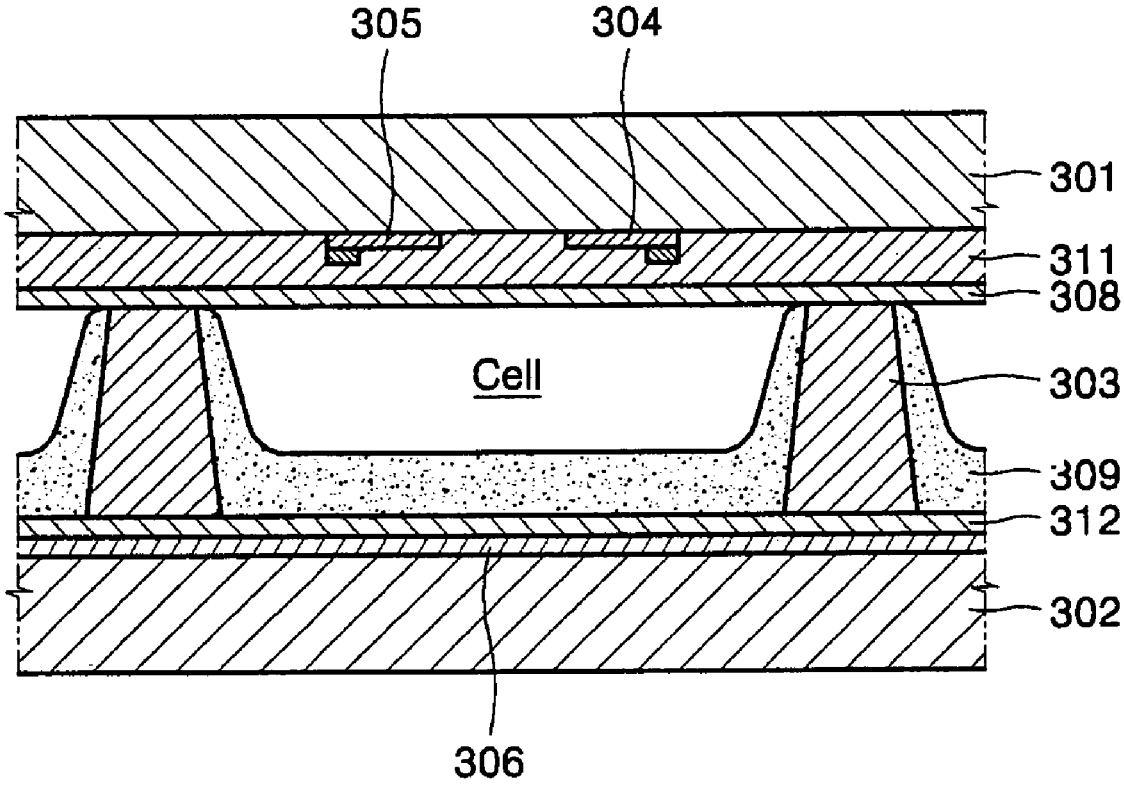
FIG. 2C is a cross-sectional view of the electrode structure of a conventional PDP in comparison with a PDP according to an embodiment of the present invention.

FIG. 2A is a partially exploded perspective view of the physical structure of the display panel 112 of the PDP of FIG. 1, FIG. 2B is a cross-sectional view of the display panel taken along line II-II in FIG. 2A, and FIG. 2C is a cross-sectional view of the electrode structure of a conventional PDP in comparison with that of a PDP in accordance with an embodiment of the present invention.

Referring to FIGS. 2A and 2B, the display panel 112 includes a front substrate 201, a rear substrate 202, barrier ribs 203, an X electrode 204, a Y electrode 205, an R electrode 206, a dielectric layer 207, a protection film 208, and a phosphor layer 209.

Discharge cells 210 disposed between the front substrate 201 and the rear substrate 202 are unit discharge spaces partitioned by the barrier ribs 203 and generate a discharge.

The barrier ribs 203 are used to restrict the discharge cells 210 to form a basic unit of an image and to prevent crosstalk between the discharge cells 210. The barrier ribs 203 can form vertically crossed sections of the discharge cells 210 to be in a shape of a polygon such as a tetragon, a hexagon, an octagon, etc. However, as shown in FIG. 2A, the barrier ribs 203 form vertically crossed sections of the discharge cells 210 to be in a circular shape in order to increase discharge efficiency.

The X electrode 204 surrounds sides of the discharge cells 210 to be parallel to the front (toward the front substrate 201) and rear (toward the rear substrate 202) of the discharge cells 210.

The Y electrode 205 surrounds sides of the discharge cells 210 to be parallel to the front and rear of the discharge cells 210 in the same manner as that of the X electrode 204.

The R electrode 206 which is disposed between the X electrode 204 and the Y electrode 205 surrounds sides of the discharge cells 210 to be parallel to the front and rear of the discharge cells 210.

The dielectric layer 207 is used as an insulating film of the X electrode 204, the Y electrode 205, and the R electrode 206 and uses a high insulation resistance material. Some charges generated by the discharge form wall charges by being accumulated near (spaced by the protection film 208) the dielectric layer 207 by electrical magnetism according to the polarity of voltages supplied to each of the X electrode 204, the Y electrode 205, and the R electrode 206, and provide an electric field to discharge space by adding a wall charge voltage generated by the wall charges to the driving voltages supplied to each of the X electrode 204, the Y electrode 205, and the R electrode 206.

FIGS. 2A and 2B illustrate that the dielectric layer 207 and the barrier ribs 203 form different layers. However, according to an embodiment of the PDP of the present invention, the barrier ribs 203 can be formed as the dielectric layer 207 or can include the dielectric layer 207.

The protection film 208 prevents the dielectric layer 207 from being damaged due to ion-sputtering and makes discharge easy by increasing the discharge of secondary electron. The protection film 208 is composed of magnesium oxide (MgO).

A photoluminescence (PL) mechanism, which emits visible light rays when electrons, excited by absorbing Vacuum Ultra Violet (VUV) light generated by a discharge in a stable state, are detected on the phosphor layer 209. The phosphor layer 209 includes a red light-emitting phosphor layer, a green light-emitting phosphor layer, and a blue light-emitting phosphor layer such that the PDP can realize a color image, and the three phosphor layers are arranged in the discharge cells 210 to form a unit pixel. The red light-emitting phosphor layer is (Y,Gd)BO3:Eu3+, etc., the green light-emitting phosphor layer is Zn2SiO4:Mn2+, etc., and the blue light-emitting phosphor layer is BaMgAl10O17:Eu2+, etc.

A discharge gas (below about 0.5 atm) having a lower pressure than an atmospheric pressure is injected into the discharge cells 210 such that discharge gas particles and charges collide due to an electric field in the discharge space by adding a wall charge voltage generated by the wall charge to the driving voltages supplied to each of the X electrode 204, the Y electrode 205, and the R electrode 206 relating to the discharge cells 210, thereby generating a plasma discharge and accordingly generating the VUV light. The discharge gas is a mixture of xenon Xe gas and one gas or two or more gases among neon Ne, helium He, and argon Ar.

Referring to FIG. 2C, a display panel of the conventional PDP has a structure that a scan electrode Yn and a sustain electrode Xn are disposed on a front substrate and an address electrode Am is disposed on a rear substrate.

The conventional PDP has a low permeability since the visible light rays generated during a sustain discharge process must pass through the front substrate, a pair of sustain discharge electrodes (the scan electrode Yn and the sustain electrode Xn), the dielectric layer, and a protection film of the front panel. The conventional PDP also has a low light-emitting efficiency since a sustain discharge is generated in the front of a discharge cell in which the scan electrode Yn and the sustain electrode Xn are disposed, thereby inefficiently utilizing the discharge space. Also, charged particles created by the discharge occur in the front of the discharge cell to cause ion-sputtering that damages the phosphor layer disposed in the rear of the discharge cell.

In order to solve such problems of the conventional PDP, the present invention provides the PDP having the electrode structure as illustrated in FIGS. 2A and 2B. The PDP of the present invention has a high permeability since the visible light rays generated during a sustain discharge process directly pass through only the front substrate and has an advantage in facilitating a high brightness. Also, the PDP of the present invention has a high light-emitting efficiency since a pair of the sustain discharge electrodes (the X electrode 204 and the Y electrode 205) surround sides of the discharge cells 210 to be parallel to the front and rear of the discharge cells 210. Thus, the discharge space of the discharge cells 210 is efficiently utilized. Since the electric field formed by voltages supplied to each of the X electrode 204, the Y electrode 205, and the R electrode 206 are in parallel to the front and rear of the discharge cells 2, charged particles created by the discharge reduce ion-sputtering that damage the phosphor layer disposed in the rear of the discharge cells 210.

Figure 3:
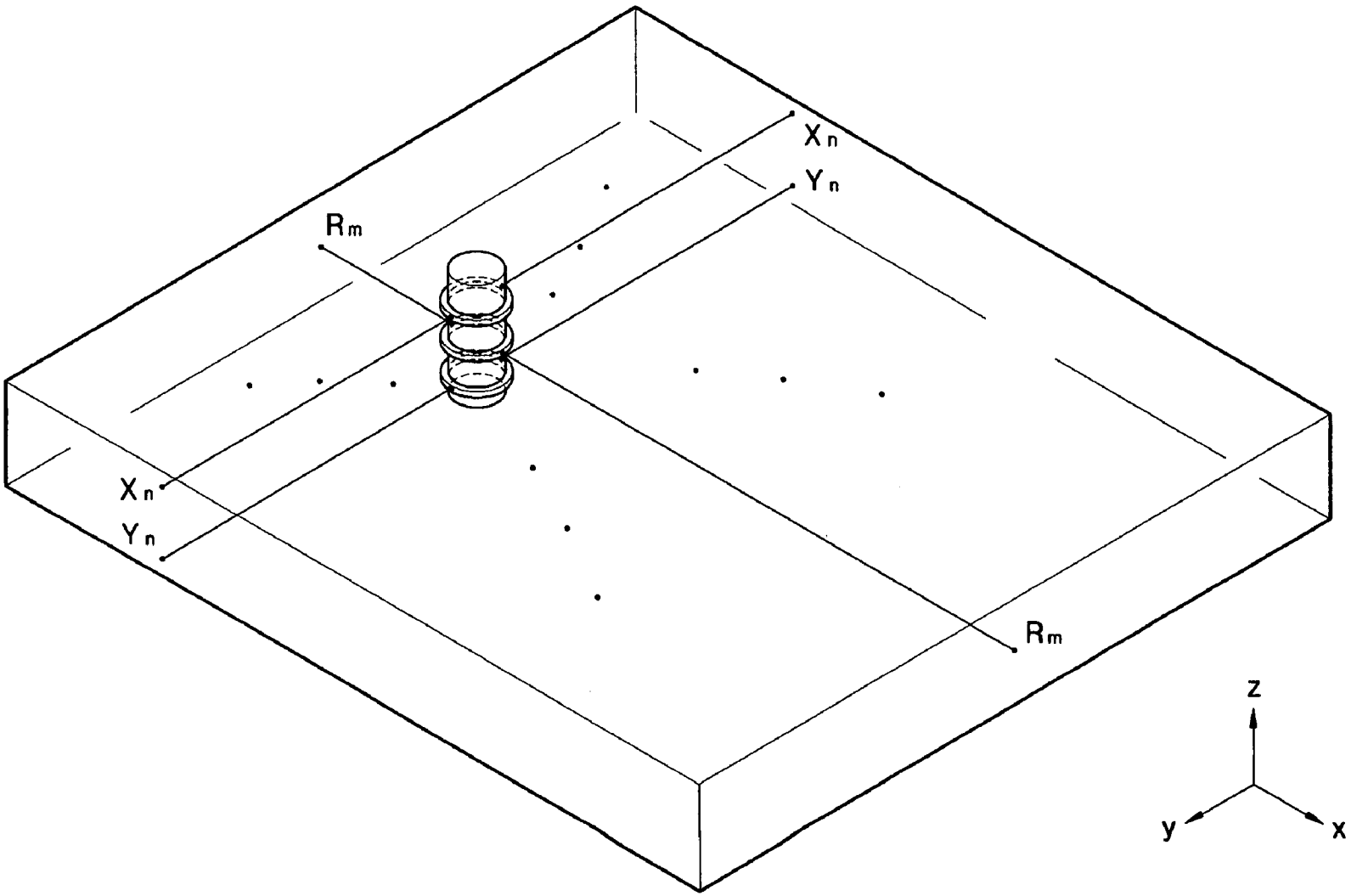
FIG. 3 is a diagram of extending directions of the X electrode, Y electrode, and R electrode that surround sides of a discharge cell.

FIG. 3 is a diagram of extending directions of the X electrode, Y electrode, and R electrode that surround sides of a discharge cell.

Referring to FIG. 3, the discharge cell has a circular shape to efficiently use the whole discharge space and can have a hexahedron shape having a cross-section of a tetragon as circumstances require.

The discharge cell includes a front facing a front substrate, a rear facing a rear substrate, and sides perpendicular to the front and rear. The shape of the sides of the discharge cell depend on what spaces between the front substrate and the rear substrate are partitioned by barrier ribs. Sides of a cylindrical discharge cell have curved surfaces.

The X electrode Xn surrounds the sides of the discharge cell to be parallel to the front of the discharge cell and extends in a direction (a Y axis direction in FIG. 3) in parallel to the front and rear of the discharge cell.

The Y electrode Yn surrounds the sides of the discharge cell to be parallel to the front of the discharge cell and extends in an extending direction (the Y axis direction in FIG. 3) of the X electrode.

The R electrode Rm is disposed between the X electrode and the Y electrode and surrounds the sides of the discharge cell to be parallel to the front of the discharge cell, and extends in a direction (an X axis direction in FIG. 3) in parallel to the front and rear of the discharge cell and perpendicular to an extending direction of the Y electrode.

Figure 4:
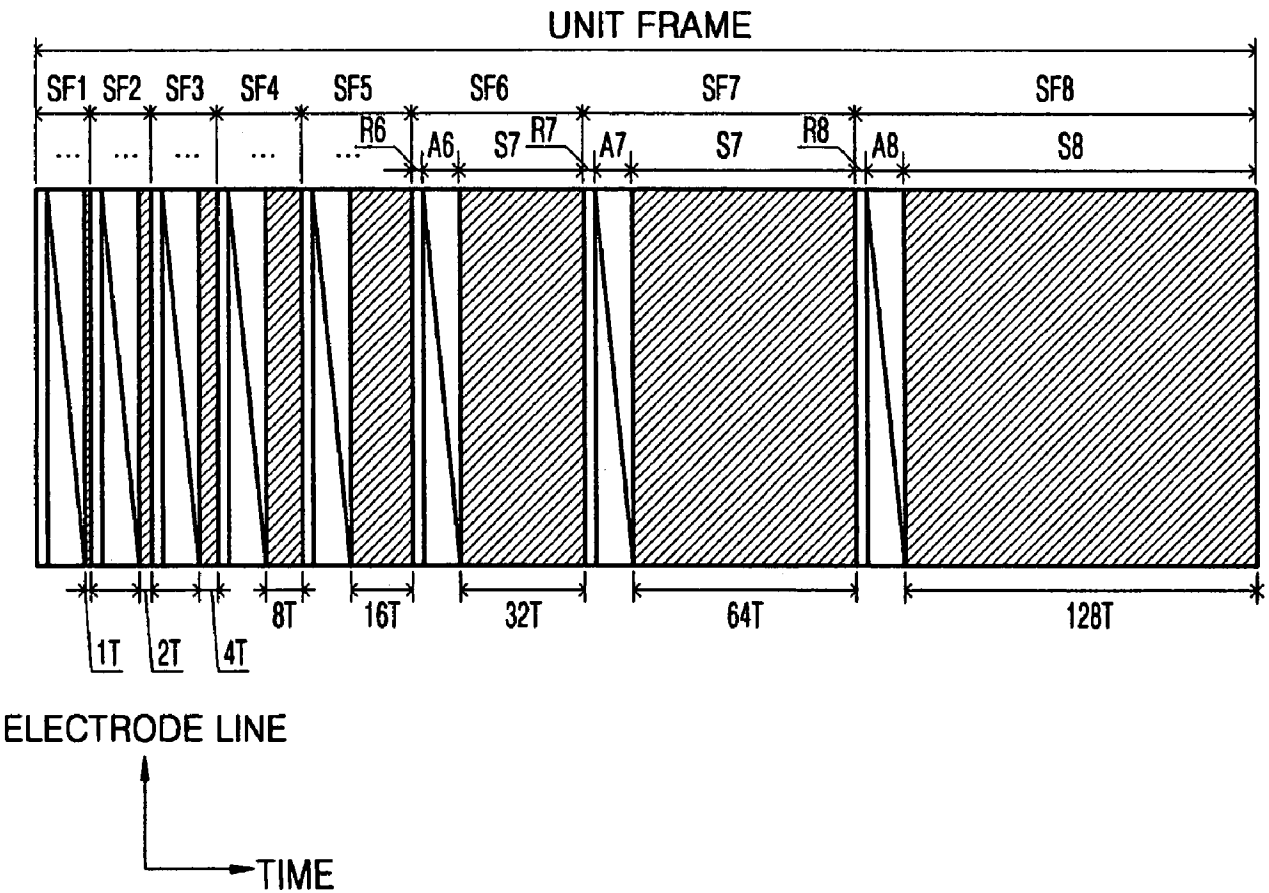
FIG. 4 is a timing diagram of a method of driving a PDP using an Address Display Separation (ADS) scheme.

FIG. 4 is a timing diagram of a method of driving a PDP using an Address Display Separation (ADS) scheme. Referring to FIG. 4, each unit frame used to express an image is divided into 8 sub-fields SF1 through SF8 in order to achieve time-division gradation display. Also, each of the sub-fields SF1 through SF8 is respectively divided into a reset period R1 through R8, an address period A1 through A8, and a sustain discharge period S1 through S8. Each of the reset periods R1 through R8 equally initializes all discharge cells, each of the address periods A1 through A8 selects a discharge cell that generates a display charge in each of the reset periods R1 through R8, and each of the sustain discharge period S1 through S8 generates a sustain discharge for the discharge cell selected in the address periods A1 through A8.

The brightness of the PDP is proportional to the total frequency of sustain discharges generated in the sustain discharge period S1 through S8 in a unit frame. For example, when the unit frame is divided into the eight sub-fields SF1 through SF8 and the brightness of the unit frame is classified into 256 gray-levels (zero gray-level to 255 gray-level), sustain discharge frequencies are sequentially allocated to each of the sustain discharge period S1 through S8 of the eight sub-fields SF1 through SF8 at rates of 1, 2, 4, 8, 16, 32, 64, and 128. If the brightness of 133 gray-level is displayed, since 133 is a sum of 1 (corresponding to SF1) and 4 (corresponding to SF3) and 128 (corresponding to SF8), a discharge cell is selected at the address period A1 of the first sub-field SF1, the address period A3 of the third sub-field SF3, and the address period A8 of the eighth sub-field SF8 and a discharge cell is not selected at the respective address periods A2, A4, A5, A6, and A7 of the sub-fields SF2, SF4, SF5, SF6, and SF7.

In FIG. 4, a horizontal axis corresponds to a time axis and a vertical axis corresponds to a scan electrode line that supplies a voltage of a scan pulse to select a discharge cell during the address periods. Since the scan pulse is supplied to the R electrode in driving the PDP according to the present invention (this will be described in detail with reference to FIG. 6), the horizontal axis can correspond to an R electrode line.

Figure 5:
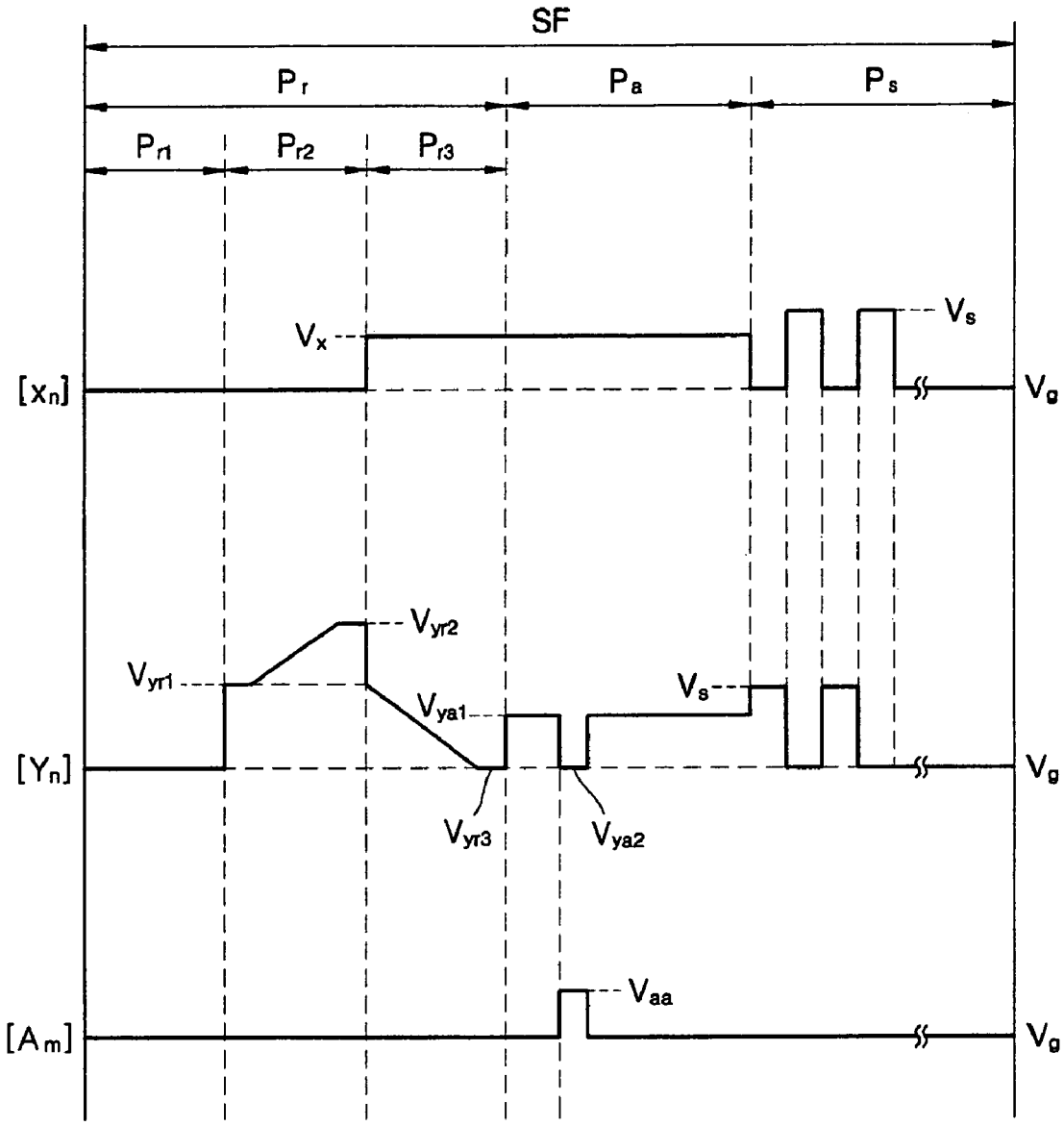
FIG. 5 is a waveform diagram of voltages supplied to electrodes in one of sub-fields forming a unit frame with regard to the conventional PDP having the electrode structure of FIG. 2C.

FIG. 5 is a waveform diagram of voltages supplied to electrodes in one of sub-fields forming a unit frame with regard to the conventional PDP having the electrode structure of FIG. 2C.

Referring to FIG. 5, voltages supplied to electrodes are as follows. A sub-field includes a rest period Pr, an address period Pa, and a sustain discharge period Ps.

In the reset period Pr, a step waveform voltage that is maintained at a ground voltage Vg and rises to a sustain electrode reset voltage Vx step by step is supplied to a sustain electrode Xn, a waveform voltage that is maintained at the ground voltage Vg (during a first reset period Pr1), ramp-rises from a first scan electrode voltage Vyr1 to a second scan electrode voltage Vyr2 (during a second reset period Pr2), and ramp-falls from the first scan electrode voltage Vyr1 to a third scan electrode voltage Vyr3 (during a third reset period Pr3) is supplied a scan electrode Yn, and the ground voltage Vg is supplied to an address electrode Am, thereby initializing every discharge cell.

In the address period Pa, a sustain electrode address voltage Vx having the same electrical potential as the sustain electrode reset voltage Vx is supplied to the sustain electrode Xn, a falling pulse waveform voltage (hereinafter referred to as a scan pulse) that is sequentially maintained at a first scan electrode address voltage Vya1, a second scan electrode address voltage Vya2 during a predetermined period, and the first scan electrode address voltage Vya1 is supplied to the scan electrode Yn, and a rising pulse waveform voltage (hereinafter referred to as a display data signal) that is maintained at the ground voltage Vg, an address electrode address voltage Vaa during a predetermined period, and the ground voltage Vg is supplied to the address electrode Am, thereby selecting a discharge cell that will generate a sustain discharge during the sustain discharge period Ps.

In the sustain discharge period Ps, a sustain pulse that is alternately the ground voltage Vg and a sustain discharge voltage Vs during predetermined period intervals is supplied to the sustain electrode Xn, a sustain pulse that is supplied to the sustain electrode Xn is alternately supplied to the scan electrode Yn, the ground voltage Vg is supplied to the address electrode Am, thereby generating the sustain discharge by the discharge cell selected in the address period Pa.

As such, since driving waveform voltages are supplied to each of the three electrodes, a reset discharge (a counter discharge generated between electrodes disposed on different flats or a surface discharge generated between electrodes disposed on the same flat) is generated in the reset period, an address discharge (the counter discharge) is generated in the address period, and a sustain discharge (the surface discharge) is generated in the sustain discharge period.

The brightness of the PDP is proportional to the total frequency of sustain discharges generated in the total sustain discharge periods in a unit frame. Since the sustain discharge is a strong discharge type, visible light rays generated in a strong discharge process penetrate a front panel and stimulate a user's viewing that watches the PDP. The reset discharge of the reset period and the address discharge of the address period are weak discharge types, they do not directly influence the brightness of the unit frame, the discharge cell is initialized only by the reset discharge, and the discharge cell that generates the sustain discharge is selected by the address discharge. Therefore, a display discharge that influences the brightness of the unit frame is the sustain discharge, and the reset discharge and the address discharge are not the display discharge.

When the reset discharge is not the weak discharge type but rather is the strong discharge type in the reset period, a discharge cell that is not selected in the address period generates the sustain discharge in the sustain discharge period and has a bad influence upon the display of the brightness of the unit frame. Therefore, in order to prevent the display quality of the PDP from being deteriorated due to erroneous discharges, a PDP driven by a method of guaranteeing a stable discharge is required.

In particular, when the pair of the sustain discharge electrodes (X electrodes and Y electrodes) and the R electrodes are disposed in the front of the discharge cells like the PDP according to the present invention, since all the electrodes are disposed on the same flat (or the same curved surface), it is necessary to more elaborately control the wall charge accumulated around each of the electrodes.

Figure 6:
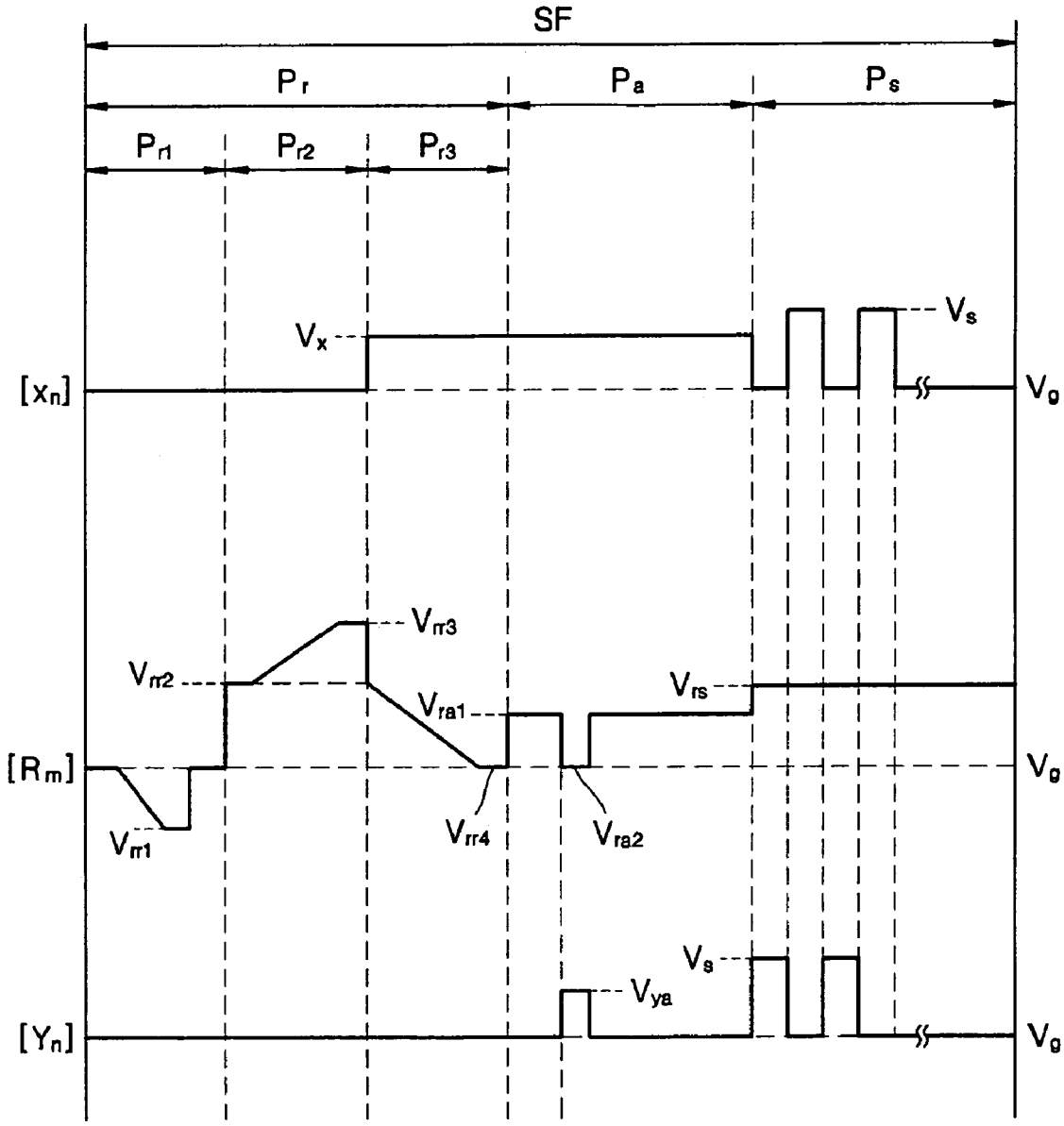
FIG. 6 is a waveform diagram of voltages supplied to electrodes in one of sub-fields forming the unit frame with regard to the PDP according to an embodiment of the present invention.

FIG. 6 is a waveform diagram of voltages supplied to electrodes in one of sub-fields forming the unit frame with regard to the PDP according to an embodiment of the present invention.

In FIG. 5, the reset pulse that performs a reset function using the reset discharge is supplied to the scan electrode Yn, whereas, in FIG. 6, the reset pulse is supplied to an R electrode Rm. In particular, in FIG. 5, the ground voltage Vg is supplied to the scan electrode Yn in the first reset period Pr1, whereas, in FIG. 6, the scan electrode Yn is maintained with the ground voltage Vg in the first reset period Pr1 and is supplied by a waveform voltage that ramp-falls from the ground voltage Vg to a first R electrode reset voltage Vrr1.

Referring to FIG. 6, a sub-field SF includes a rest period Pr, an address period Pa, and a sustain discharge period Ps.

Voltages supplied to electrodes Xn, Yn, and Rm in the reset period Pr are as follows.

A step waveform voltage that is sequentially maintained at a ground voltage Vg and an X electrode reset voltage Vx having a higher electrical potential than that of the ground voltage Vg is supplied to the X electrode Xn. The ground voltage Vg is supplied to the Y electrode Yn.

In a first reset period Pr1, a waveform voltage that is maintained at the ground voltage Vg, ramp-falls to a first R electrode reset voltage Vrr1 having a lower electrical potential than that of the ground voltage Vg, is maintained at the first R electrode reset voltage Vrr1, step-rises to the ground voltage Vg, and again is maintained at the ground voltage Vg is supplied to the R electrode Rm.

In a second rest period Pr2, a waveform voltage that is maintained at a second R electrode reset voltage Vrr2 having a higher electrical potential than that of the ground voltage Vg, ramp-rises to a third R electrode reset voltage Vrr3 having a higher electrical potential than that of the second R electrode reset voltage Vrr2, and is maintained at the third R electrode reset voltage Vrr3 is supplied to the R electrode Rm.

In a third rest period Pr3, a waveform voltage that ramp-rises from the second R electrode reset voltage Vrr2 having a higher electrical potential than that of the ground voltage Vg to a fourth R electrode reset voltage Vrr4 having a lower electrical potential than that of the second R electrode reset voltage Vrr2, and is maintained at the fourth R electrode reset voltage Vrr4 is supplied to the R electrode Rm.

The electrical potential of the fourth R electrode reset voltage Vrr4 is illustrated as that of the ground voltage Vg in FIG. 6. However, the electrical potential of the fourth R electrode reset voltage Vrr4 can be lower than that of the ground voltage Vg in driving the PDP according to the present invention.

Voltages supplied to electrodes Xn, Yn, and Rm in the address period Pa are as follows.

An X electrode address voltage Vx having the same electrical potential as that of the X electrode reset voltage Vx is supplied to the X electrode Xn. A pulse waveform voltage (a display data signal) that is sequentially maintained at the ground voltage Vg, a Y electrode address voltage Vya having a higher electrical potential than that of the ground voltage Vg during a predetermined period, and again the ground voltage Vg is supplied to the Y electrode Yn.

A pulse waveform voltage (a scan pulse) that is sequentially maintained at a first R electrode address voltage Vra1 having a higher electrical potential than that of the ground voltage, a second R electrode address voltage Vra2 (having the same electrical potential as that of the ground voltage Vg in FIG. 6) having a lower electrical potential than that of the first R electrode address voltage Vra1 during a predetermined period, and again the first R electrode address voltage Vra1 is supplied to the R electrode Rm.

Voltages supplied to electrodes Xn, Yn, and Rm in the sustain period Ps are as follows.

A sustain pulse that is alternately the ground voltage Vg and the sustain discharge voltage Vs in predetermined period intervals is supplied to the X electrode Xn. A sustain pulse is alternately supplied to the Y electrode Yn in opposition to the ground voltage and the sustain discharge voltage supplied to the X electrode Xn. An R electrode sustain voltage Vrs having a higher electrical potential than that of the ground voltage Vg is supplied to the R electrode Rm.

In the conventional PDP, the ground voltage Vg is supplied to the scan electrode Yn (in FIG. 5) in the first reset period Pr1 (in FIG. 5), whereas, in the PDP of the present invention, the falling ramp type pulse waveform voltage is supplied to the scan electrode Rm (in FIG. 6) in the first reset period Pr1 (in FIG. 6). The positive effect of the PDP of the present invention obtained by supplying the falling ramp type pulse waveform voltage instead of the ground voltage in the first reset period Pr1 is described below with reference to FIGS. 7A and 7F.

FIGS. 7A through 7F are views of distributions of wall charges accumulated around each of electrodes in each period of FIG. 6.

Figure 7A:
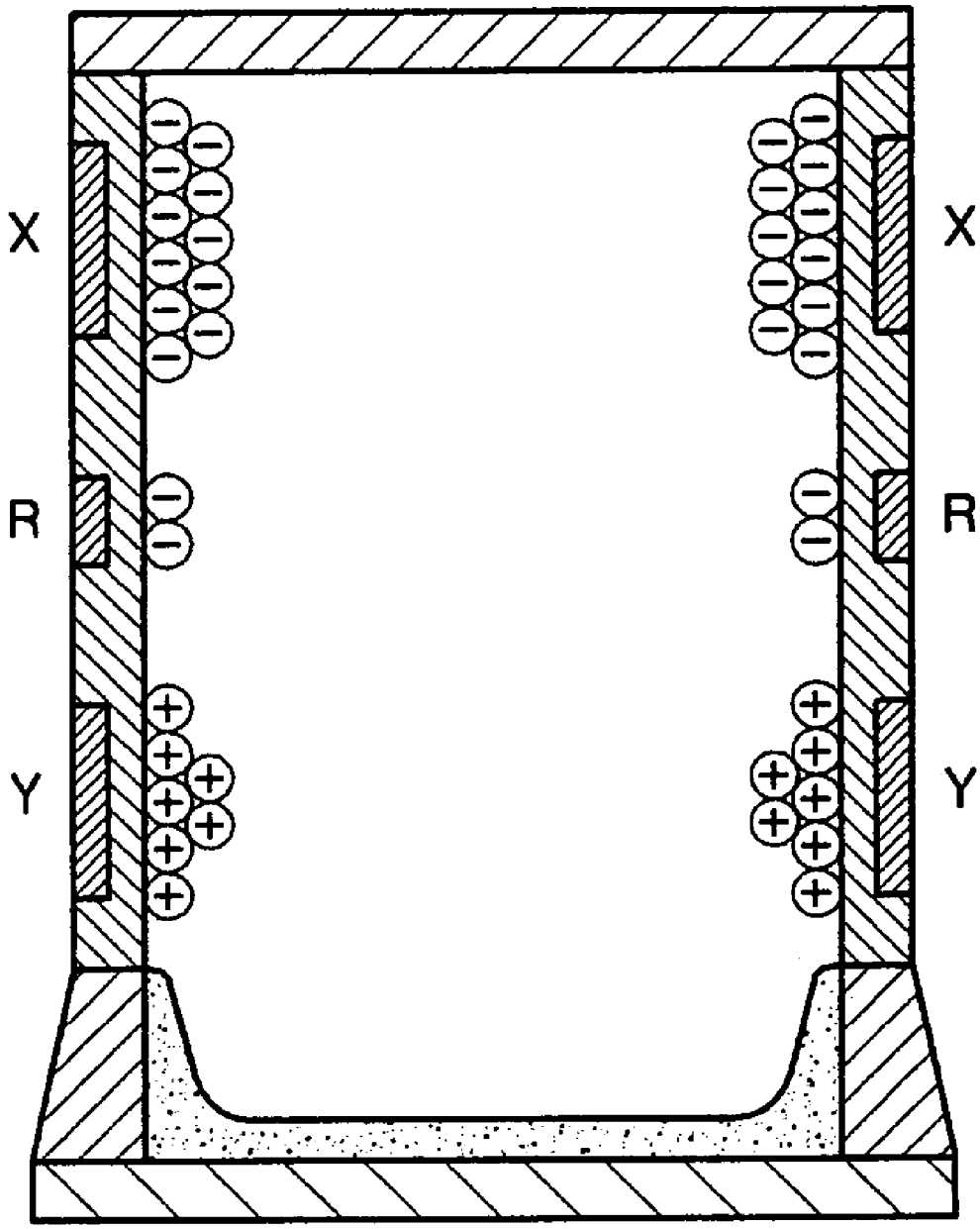
FIGS. 7A through 7F are views of distributions of wall charges accumulated around each of electrodes in each period of FIG. 6.

FIG. 7A illustrates distributions of wall charges accumulated around each of electrodes after the final sustain discharge Ps.

Considering that in the final sustain discharge, the sustain discharge voltage Vs is supplied to the X electrode, the ground voltage Vg is supplied to the Y electrode, and the R electrode sustain voltage Vrs is supplied to the R electrode, charges generated by the final sustain discharge are accumulated around an electrode to which a voltage having an opposite polarity is supplied by an electric field due to voltages supplied to each of the electrodes to form a wall charge. That is, a large quantity of negative wall charges are formed around the X electrode, a small quantity of negative wall charges are formed around the R electrode, and a large quantity of positive wall charges are formed around the Y electrode.

Figure 7B:
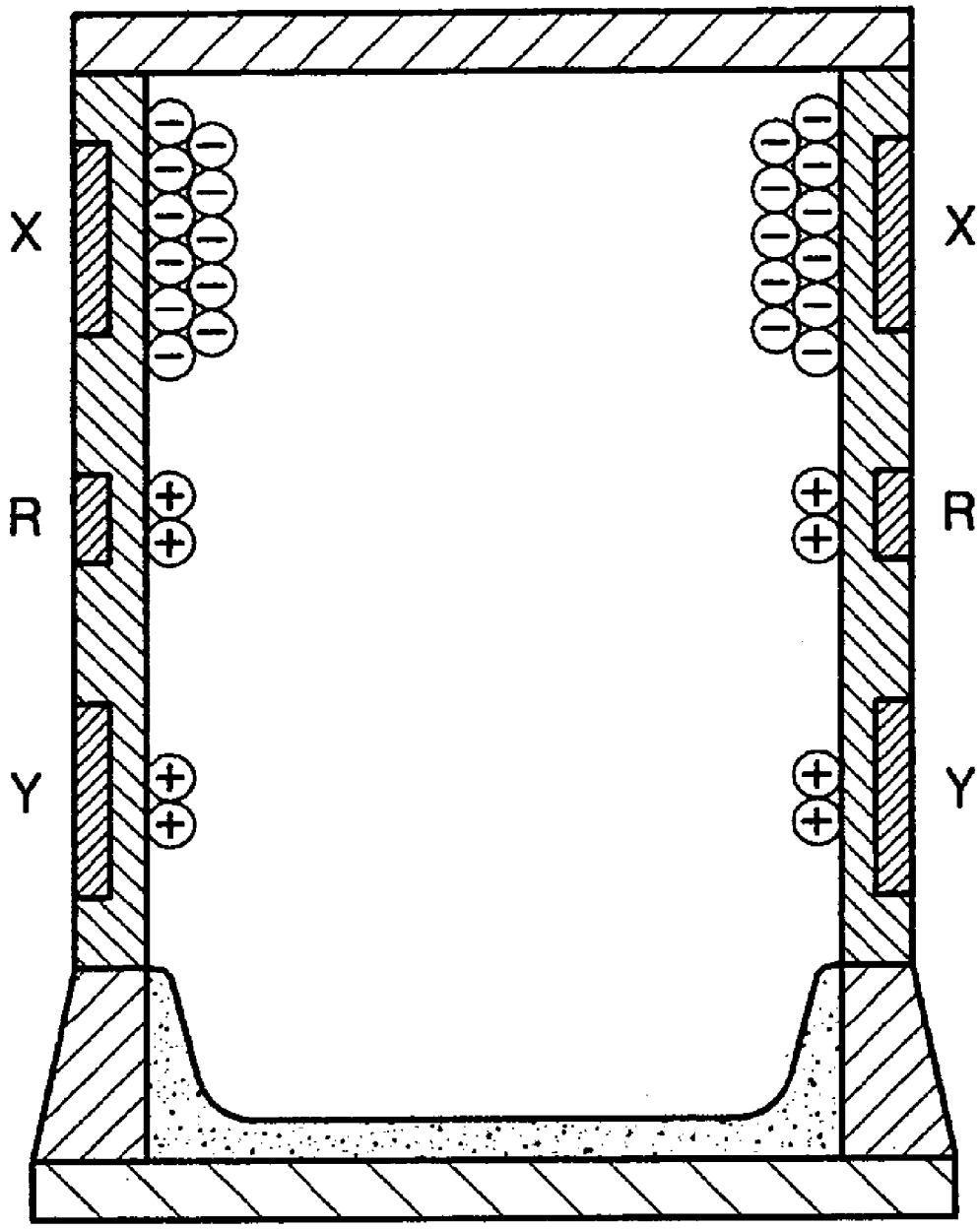

FIG. 7B illustrates distributions of wall charges accumulated around each of electrodes after the first reset period Pr1.

In the first reset period Pr1, the ground voltage Vg is supplied to the X electrode, the ground voltage Vg is supplied to the Y electrode, and the falling ramp type pulse waveform voltage that ramp-falls from the ground voltage Vg to the first R electrode reset voltage Vrr1 is supplied to the R electrode.

The voltages supplied to each of the electrodes are added to the wall voltage generated by the wall charges accumulated around each of the electrodes after the final sustain discharge Ps to cause an electric field in the discharge space, thereby generating a weak reset discharge in the R electrode and the Y electrode. However, since a large number of negative wall charges are formed around the electrode, no discharge is generated between the R electrode and the X electrode. Charges generated by the discharge are accumulated around the electrodes to which voltages having the opposite polarity is supplied by the electric field generated by the voltages supplied to each of the electrodes to form the wall charges as illustrated in FIG. 7B. That is, a large quantity of negative wall charges are formed around the X electrode, a small quantity of positive wall charges are formed around the R electrode, and a small quantity of positive wall charges are formed around the Y electrode.

Figure 7C:
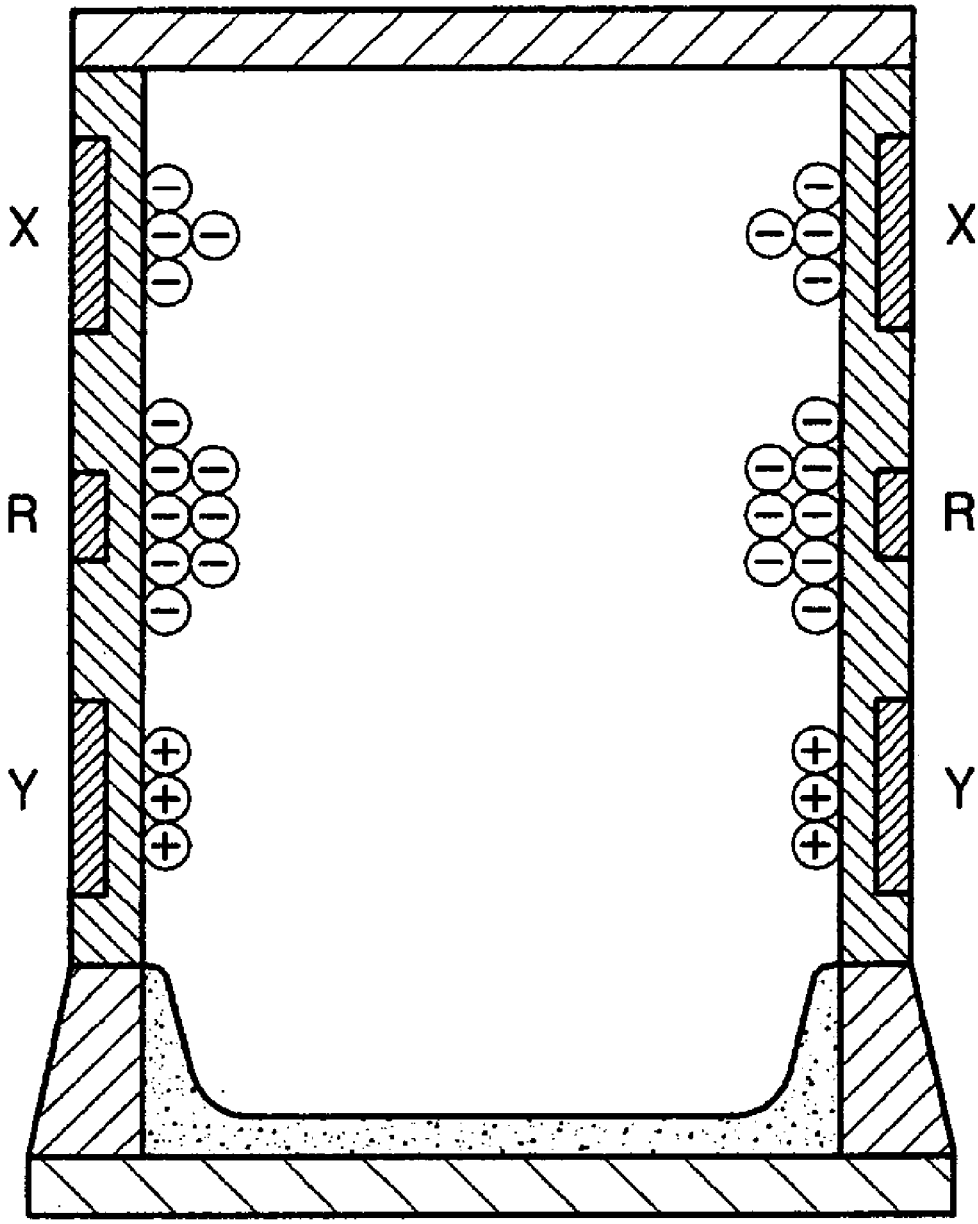

FIG. 7C illustrates distributions of wall charges accumulated around each of electrodes after the second reset period Pr2.

In the second reset period Pr2, the ground voltage Vg is supplied to the X electrode, the ground voltage Vg is supplied to the Y electrode, and the rising ramp type pulse waveform voltage that ramp-rises from the second R electrode reset voltage Vrr2 to the third R electrode reset voltage Vrr3 is supplied to the R electrode. The voltages supplied to each of the electrodes is added to the wall voltage generated by the wall charges accumulated around each of the electrodes after the first reset period Pr1 to cause an electric field in the discharge space, thereby generating a weak reset discharge in the R electrode and the Y electrode. Charges generated by the discharge are accumulated around the electrodes to which voltages having the opposite polarity is supplied by the electric field generated by the voltages supplied to each of the electrodes to form the wall charges as illustrated in FIG. 7C. That is, negative wall charges are formed around the X electrode, a large quantity of negative wall charges are formed around the R electrode, and positive wall charges are formed around the Y electrode.

Figure 7D:
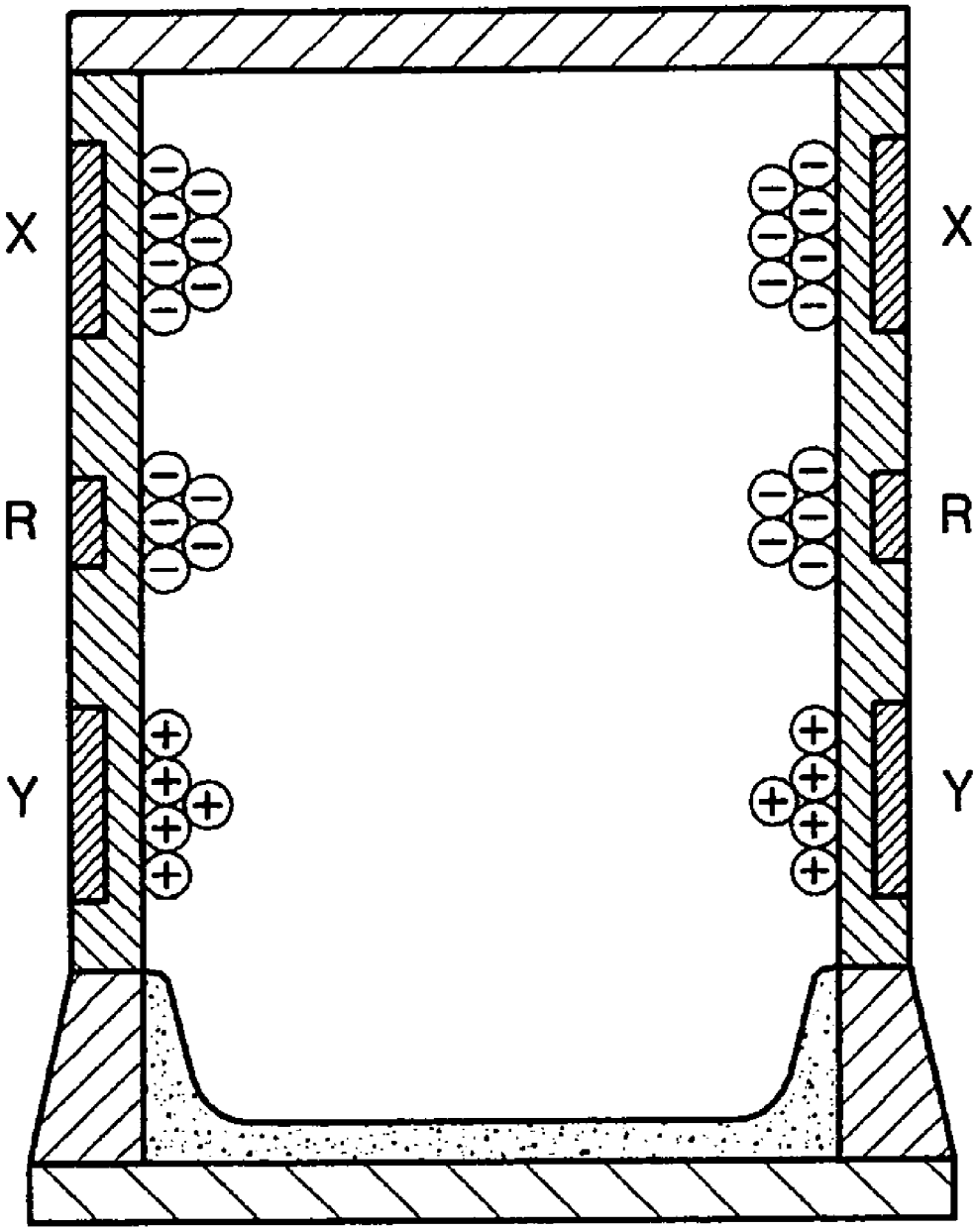

FIG. 7D illustrates distributions of wall charges accumulated around each of electrodes after the third reset period Pr3.

In the third reset period Pr3, the X electrode reset voltage Vx is supplied to the X electrode, the ground voltage Vg is supplied to the Y electrode, and the falling ramp type pulse waveform voltage that ramp-falls from the second R electrode reset voltage Vrr2 to the fourth R electrode reset voltage Vrr4 is supplied to the R electrode. The voltages supplied to each of the electrodes are added to the wall voltage generated by the wall charges accumulated around each of the electrodes after the second reset period Pr2 to cause an electric field in the discharge space, thereby again generating a weak reset discharge. Charges generated by the discharge are accumulated around the electrodes to form the wall charges as illustrated in FIG. 7D. That is, negative wall charges are formed around the X electrode, negative wall charges are formed around the R electrode, and positive wall charges are formed around the Y electrode.

The characteristics of the reset periods Pr1, Pr2, and Pr3 according to the present invention are discussed below.

In the conventional PDP, when the ground voltage Vg is supplied to the scan electrode (Yn in FIG. 5 and Rm in FIG. 6) in the first reset period Pr1, a weak reset discharge is not generated. To be more specific, since the wall charges shown in FIG. 7A are added to the wall voltage generated by the voltages supplied to each of the electrodes in the second reset period Pr2, the weak reset discharge is not generated between the R electrode and the Y electrode but rather between the R electrode and the X electrode. However, the falling ramp type pulse waveform voltage is supplied in the first reset period Pr1 in the present invention, thereby generating a weak reset discharge between the R electrode and the Y electrode in the first reset period Pr1.

The conventional PDP generates a weak reset discharge (during the second reset period Pr2) between the R electrode and the X electrode after the final sustain discharge (during the sustain discharge period Ps), whereas the present invention generates a weak reset discharge (during the first reset period Pr1) between the R electrode and the Y electrode after the final sustain discharge and then the weak reset discharge (during the second reset period Pr2) between the R electrode and the X electrode. In addition, since the present invention generates the weak reset discharge in the font side space (between the X electrode and the R electrode) of the discharge cell and the rear side space (between the Y electrode and the R electrode) thereof, priming particles are increased in discharge space of the discharge cell to have a low discharge start voltage, thereby making discharge easier in the address period Pa or the sustain discharge period Ps.

As such, the characteristic of the present invention is to improve ability to control the wall charges around the Y electrode by additionally generating the weak reset discharge between the R electrode and the Y electrode in the first reset period Pr1, thereby performing a stable discharge in the reset period Pr to increase the whole discharge stability, and increasing the priming particles in the discharge space to have the low discharge start voltage.

All discharge cells are initialized to equally distribute the wall charges after the first, second, and third reset periods Pr1, Pr2, and Pr3, and are prepared to select a discharge cell in the address period Pa.

Figure 7E:
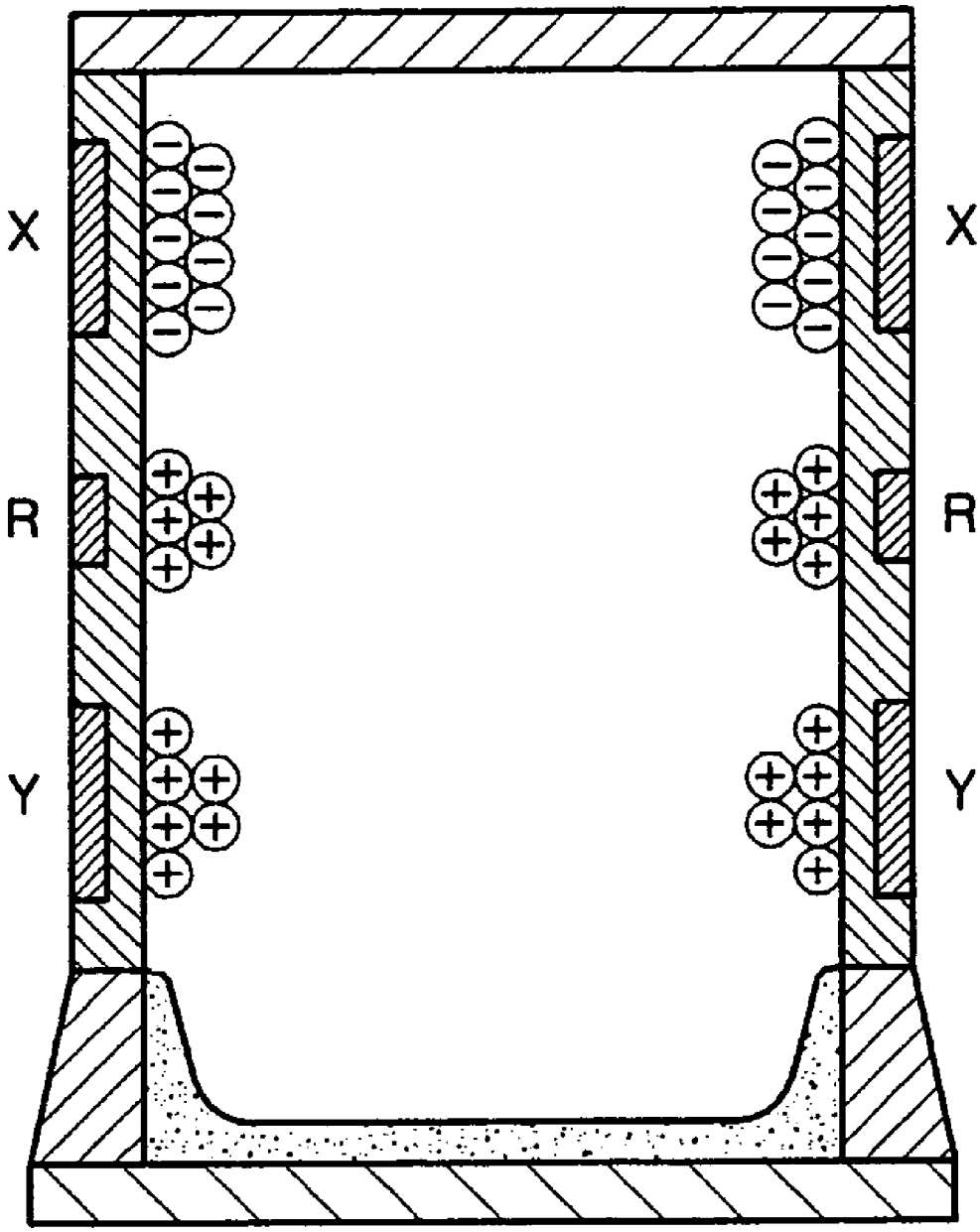

FIG. 7E illustrates distributions of wall charges accumulated around each of electrodes after the address period Pa.

In the address period Pa, the X electrode address voltage Vx is supplied to the X electrode Xn, the pulse waveform voltage that is sequentially maintained at the ground voltage Vg, the Y electrode address voltage Vya during the predetermined period, and the ground voltage Vg is supplied to the Y electrode Yn, and the pulse waveform voltage that is sequentially maintained at the first R electrode address voltage Vra1, the second R electrode address voltage Vra2 during the predetermined period, and the first R electrode address voltage Vra1 is supplied to the R electrode Rm. The voltages supplied to each of the electrodes is added to the wall voltage generated by the wall charges accumulated around each of the electrodes after the third reset period Pr3 to provide the electric field to discharge space, thereby again generating a weak reset discharge between the R electrode Rm and the Y electrode Yn. Charges generated by the discharge are accumulated around the electrodes to which voltages having the opposite polarity is supplied by the electric field generated by the voltages supplied to each of the electrodes to form the wall charges as illustrated in FIG. 7E. That is, a large quantity of negative wall charges are formed around the X electrode Xn, positive wall charges are formed around the R electrode Rm, and a large quantity of positive wall charges are formed around the Y electrode Yn.

Figure 7F:
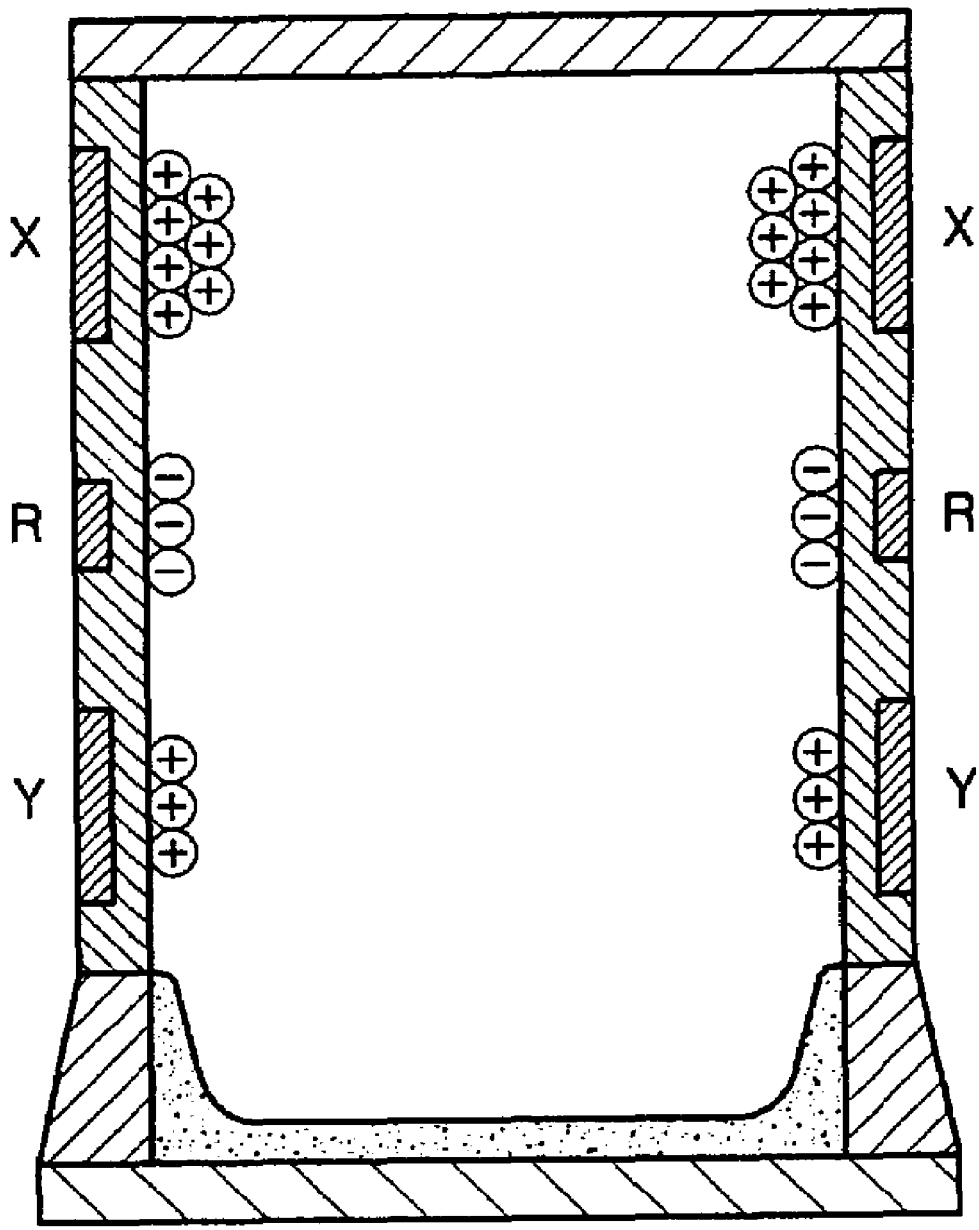

FIG. 7F illustrates distributions of wall charges accumulated around each of electrodes before a first sustain discharge in the sustain discharge period Ps.

In the first sustain discharge in the sustain discharge period Ps, the ground voltage Vg is supplied to the X electrode Xn, the sustain discharge voltage Vs is supplied to the Y electrode Yn in opposition to the ground voltage Vg supplied to the X electrode Xn?, and the R electrode sustain voltage is supplied to the R electrode Rm. The voltages supplied to each of the electrodes is added to the wall voltage generated by the wall charges to cause an electric field in the discharge space, thereby generating a weak reset discharge between the R electrode Rm and the Y electrode Yn. Charges generated by the discharge are accumulated around the electrodes to which voltages having the opposite polarity is supplied by the electric field generated by the voltages supplied to each of the electrodes to form the wall charges as illustrated in FIG. 7F. That is, a large quantity of positive wall charges are formed around the X electrode Xn, a small quantity of negative wall charges are formed around the R electrode Rm, and a small quantity of positive wall charges are formed around the Y electrode Yn.

According to the present invention, each of the electrodes are disposed to surround sides of the discharge cells in order to efficiently utilize discharge space, increasing light-emitting efficiency of the PDP, and driving voltages for increasing ability to control the wall charges accumulated around each of the electrodes disposed in sides of the discharge cells are supplied in an initial reset period, thereby increasing discharge stability of the PDP.

While the present invention has been particularly shown and described with reference to exemplary embodiments thereof, it will be understood by those of ordinary skill in the art that various modifications in form and detail can be made therein without departing from the spirit and scope of the present invention as defined by the following claims.

What is claimed is:

1. A Plasma Display Panel (PDP), comprising:

front and rear substrates spaced apart from each other and facing each other in parallel;

barrier ribs partitioning spaces between the front substrate and the rear substrate into a plurality of discharge cells having front, rear, and sides;

an X electrode and a Y electrode surrounding the sides of the discharge cell to be parallel to the front and rear of the discharge cell and extending in a direction in parallel to the front and rear of the discharge cell;

an R electrode arranged between the X electrode and the Y electrode, surrounding the sides of the discharge cell to be parallel to the front and rear of the discharge cell, and extending in a direction in parallel to the front and rear of the discharge cell and perpendicular to an extending direction of the X electrode and the Y electrode; and a phosphor layer arranged on the rear of the discharge cell;

wherein the PDP is driven by a waveform voltage that is classified into a reset period adapted to initialize all the discharge cells, an address period adapted to select a discharge cell that generates a sustain discharge, and a sustain discharge period adapted to generate the sustain discharge for the selected discharge cell; and wherein the PDP is driven by supplying a waveform voltage sequentially having a first falling ramp type pulse, a rising ramp type pulse, and a second falling ramp type pulse to the R electrode, a rising step waveform voltage to the X electrode, and a ground voltage to the Y electrode in the reset period.

2. The PDP of claim 1, wherein the first falling ramp type pulse is a waveform pulse that is maintained at a ground voltage, ramp-falls to a first R electrode reset voltage having a lower electrical potential than that of the ground voltage, is maintained at the first R electrode reset voltage, step-rises to the ground voltage, and again is maintained at the ground voltage.

3. The PDP of claim 2, wherein the rising ramp type pulse is a waveform pulse that is maintained at a second R electrode reset voltage having a higher electrical potential than that of the ground voltage, ramp-rises to a third R electrode reset voltage having a higher electrical potential than that of a second R electrode reset voltage, and is maintained at the third R electrode reset voltage.

4. The PDP of claim 1, wherein the second falling ramp type pulse is a waveform pulse that ramp-falls from a second R electrode reset voltage having a higher electrical potential than that of a ground voltage to a fourth R electrode reset voltage having a lower electrical potential than that of the second R electrode reset voltage, and is maintained at the fourth R electrode reset voltage.

5. The PDP of claim 4, wherein the electrical potential of the fourth R electrode reset voltage is less than or equal to the electrical potential of the ground voltage.

6. The PDP of claim 1, wherein the rising step waveform voltage pulse is a waveform pulse that is maintained at the ground voltage, step-rises to an X electrode reset voltage having a higher electrical potential than that of the ground voltage, and is maintained at the X electrode reset voltage.

7. The PDP of claim 1, wherein, during the address period, an X electrode address voltage having a higher electrical potential than that of a ground voltage is supplied to the X electrode, a pulse waveform voltage that is sequentially maintained at the ground voltage, a Y electrode address voltage having a higher electrical potential than that of the ground voltage during a predetermined period, and the ground voltage is supplied to the Y electrode, and a pulse waveform voltage that is sequentially maintained at a first R electrode address voltage having a higher electrical potential than that of the ground voltage, a second R electrode address voltage having a lower electrical potential than that of the first R electrode address voltage during the predetermined period, and the first R electrode address voltage is supplied to the R electrode.

8. The PDP of claim 1, wherein, during the sustain discharge period, a ground voltage and the sustain discharge voltage are alternately supplied to the X electrode at predetermined period intervals, the sustain discharge voltage and the ground voltage are alternately supplied to the Y electrode in opposition to the ground voltage and the sustain discharge voltage supplied to the X electrode, an R electrode sustain voltage having a higher electrical potential than that of the ground voltage is supplied to the R electrode.

9. A method of driving a Plasma Display Panel (PDP) including an X electrode and a Y electrode spaced apart from each other and extending in parallel and an R electrode crossing the X electrode and the Y electrode and arranged between the X electrode and a Y electrode, discharge cells arranged in the crossed space, and the X, Y, and R electrodes surrounding the discharge-cells, the method comprising:

defining a plurality of sub-fields in a unit frame according to each of gradation weights in order to display time-division gradation, each sub-field being divided into a reset period, an address period, and a sustain discharge period every sub-field; and supplying a scan pulse to the R electrode and a display data signal to the Y electrode during the address period.

10. The method of claim 9, further comprising sequentially supplying a first falling ramp type pulse, a rising ramp type pulse, and a second falling ramp type pulse to the R electrode during the reset period.

11. The method of claim 10, further comprising continuously supplying a positive R electrode sustain voltage to the R electrode and alternately supplying a sustain pulse to the Y electrode and the X electrode during the sustain discharge period.

12. The method of claim 11, further comprising supplying a rising step waveform voltage to the X electrode from the application of the second falling ramp type pulse to the end of the address period.

13. A method of driving a Plasma Display Panel (PDP) including an X electrode and a Y electrode spaced apart from each other and extending in parallel and an R electrode crossing the X electrode and the Y electrode and arranged between the X electrode and a Y electrode, discharge cells arranged in the crossed space, and the X, Y, and R electrodes surrounding the discharge cells, the method comprising:

defining a plurality of sub-fields in a unit frame according to each of gradation weights in order to display time-division gradation, each sub-field divided into a reset period, an address period, and a sustain discharge period; and sequentially supplying a first falling ramp type pulse, a rising ramp type pulse, and a second falling ramp type pulse are to the R electrode during the reset period.

* * * * *